United States Patent [19]

Flath

[11] Patent Number: 4,615,117

[45] Date of Patent: Oct. 7, 1986

[54] FITS-ALL POWER BAR

[76] Inventor: Roland Flath, Rte. 5, Box 242, Fond du Lac, Wis. 54935

[21] Appl. No.: 667,973

[22] Filed: Nov. 5, 1984

Related U.S. Application Data

[63] Continuation-in-part of Ser. No. 484,855, Apr. 14, 1983, abandoned.

[51] Int. Cl.[4] ..... B25F 3/00; B26B 11/00

[52] U.S. Cl. ..... 30/122; 30/382; 83/574

[58] Field of Search ..... 83/788, 859, 574, 701; 30/122, 381, 382, 386, 388; 474/144, 146; 279/83

[56] References Cited

U.S. PATENT DOCUMENTS

| | | | |
|---|---|---|---|
| 2,533,179 | 12/1950 | Redinger | 279/83 |
| 3,580,342 | 5/1971 | Matthews | 30/381 X |
| 3,885,471 | 5/1975 | Morine et al. | 474/144 |
| 4,063,358 | 12/1977 | Hodge | 30/371 |

*Primary Examiner*—James M. Meister
*Assistant Examiner*—John L. Knoble
*Attorney, Agent, or Firm*—Donald Cayen

[57] ABSTRACT

An attachment for greatly increasing the versatility of a conventional chain saw is capable of being mounted to a wide variety of chain saw models. The attachment is mounted to the chain saw in place of the usual chain bar. The attachment includes a rotatable spindle which may be driven through a roller chain or a V-belt drive. The spindle is adapted to drive tools such as abrasive wheels and drills. The attachment includes a housing which pilots and holds such equipment as water pumps, the impellers of which are rotated by the attachment spindle. The invention includes a sliding guard to which is mounted a chain tightening device. The guard is secured at a location which depends on the chain saw housing size so as to permit the adjustment device to bear against the chain saw housing, thereby imparting controlled tension to the driving chain or belt.

4 Claims, 8 Drawing Figures

3
7
5

53
55
39
57
18
1
14
27
9
23
33
17
15
21
52
61
41
20
29
45
59
65
13
19
62
54
35
27
50
49
89
91

T 43
31
29
33
45
53
57
55
61
27
24
25
47
23
5
31
13
54
51
63
59
58
14
65
61
50
21
39
49
89
35
91

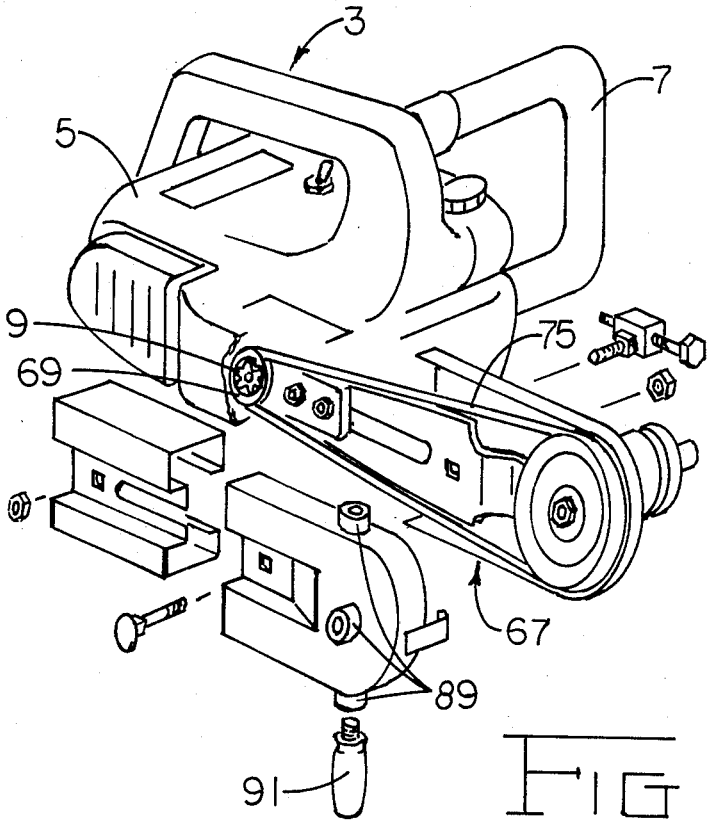
FIG. 6
FIG. 7
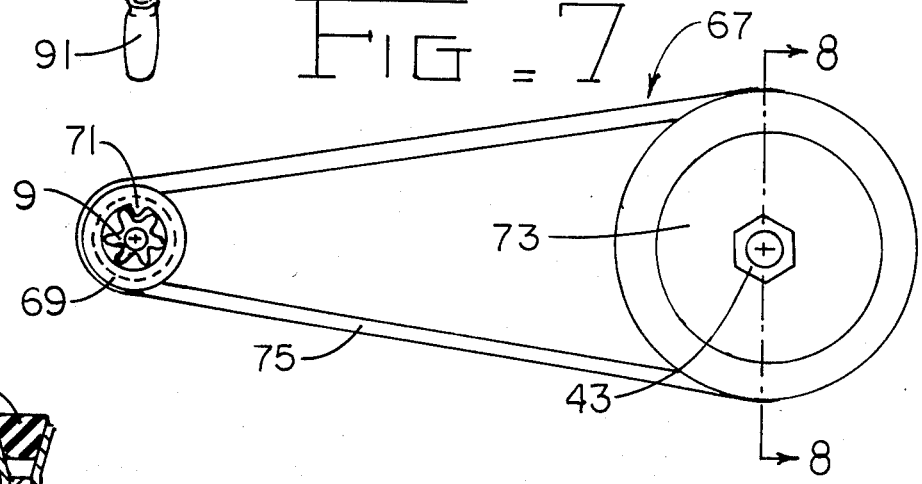
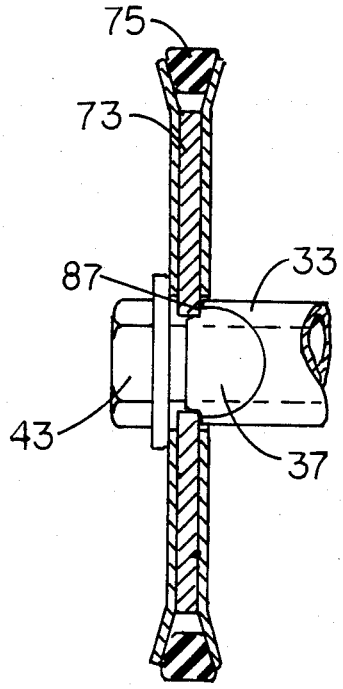
FIG. 8

FITS-ALL POWER BAR

This application is a continuation-in-part of my copending U.S. patent application Ser. No. 484,855 filed Apr. 14, 1983, now abandoned.

BACKGROUND OF THE INVENTION

1. Field of the Invention

This invention relates to portable power tools, and more particularly to attachments for existing portable power supplies which increase the versatility thereof.

2. Description of the Prior Art

Portable power tools presently manufactured and marketed normally include a light weight but powerful power source, such as a gasoline engine, in combination with a single purpose tool. Power tools such as chain saws, cut-off saws, disc grinders, weed cutters, buffers and polishers, brush cutters, and emergency water pumps are well known. It is prohibitively expensive for a person with an infrequent need for a particular power tool to stock his shop with a complete list of equipment.

To increase the versatility of single purpose power tools, special adaptations have been made to many tools. Modifications to chain saws are especially desirable, because the modern chain saw gasoline engine is well developed and combines light weight with high power. U.S. Pat. No. 2,810,409 shows a rotary cutter attachment for a chain saw which is useful for clearing brush and undergrowth. Although the attachment of the U.S. Pat. No. 2,810,409 patent increases the versatility of a conventional chain saw, it is apparent that the chain saw is nevertheless limited to only one additional use. Further, there is no positive means for locating the attachment relative to the chain saw engine for applying and maintaining proper belt tension.

U.S. Pat. No. 3,382,898 shows a spring loaded mechanism for setting and maintaining a desired chain tension during operation of a chain saw. The chain bar is reciprocalable under the action of the spring because a longitudinally adjustable spacer thicker than the chain bar is interposed between the bar mounting nut and the chain saw engine cover plate. The chain tensioning device of the U.S. Pat. No. 3,382,898 patent is not of a positive type in either the axial or transverse directions of the chain bar. Consequently, the chain bar is susceptible to vibrations along two axes during operation. Further, the chain saw is useable only for the usual sawing operations.

U.S. Pat. No. 3,533,456 discloses a brush cutter attachment for a chain saw which has an elongated mounting member having its axis coincident with the axis of the chain saw engine output sprocket. It is apparent that replacing the chain saw chain bar with the attachment of the U.S. Pat. No. 3,533,456 patent is a time-consuming procedure, because several chain saw parts must be removed. Additionally, the attachment is useful for only limited purposes.

U.S. Pat. No. 3,580,342 shows an impact wrench attachment for a chain saw. The attachment is of limited use. Moreover, there is no positive means for applying and maintaining tension to the driving chain.

U.S. Pat. No. 4,382,334 shows a cassette type chain saw having a chain tensioning mechanism in the form of a threaded device acting between the chain saw housing and the cassette. While the mechanism does provide positive chain tension and control, it requires an engine housing and cassette designed specifically for each other and is not adaptable to chain saws without the cassette feature. Moreover, the saw of the U.S. Pat. No. 4,382,334 patent is limited to the usual chain saw cutting operations.

Thus, a need exists for apparatus which converts a conventional chain saw into a variety of power driven tools in a convenient and safe manner.

SUMMARY OF THE INVENTION

In accordance with the present invention, an inexpensive and universal attachment is provided which greatly increases the versatility of a conventional chain saw. This is accomplished by apparatus which includes a universal bar which is designed to interchange with the chain bar provided as standard equipment on a chain saw and a spindle and spindle housing adapted to hold and rotate a variety of tools.

The mounting end of the universal bar contains a longitudinal slot which permits the bar to be mounted over the studs of a wide variety of chain saw housings. The distal end of the bar contains an offset portion to which is permanently joined a housing plate. A hollow spindle is mounted for rotation within a spindle housing rigidly fixed to the housing plate. A bolt passing through the spindle is utilized to hold some types of tools to the spindle for rotation therewith. Other types of rotatable equipment, such as water pumps, are mounted to the outer periphery of the spindle housing, and the spindle rotates an aligned pump shaft. The spindle may be rotated by a roller chain trained around the engine output sprocket and a similar sprocket on the spindle. The universal bar is fabricated such that it guides the roller chain in a manner generally similar to the manner in which a cutting chain is guided by the conventional chain bar. To increase user convenience and safety, the attachment of the present invention includes handles which are mountable in a variety of positions near the spindle.

To provide tension adjustment to the drive chain, the attachment of the present invention includes an adjustment screw threaded through a block which acts through the universal bar. The end of the adjustment screw bears against the chain saw engine housing, so that no modifications to the chain saw housing for providing positive tension are necessary. The adjustment block may be mounted on either side of the universal bar, thereby increasing the models of chain saws with which the attachment may be used.

Further in accordance with the present invention, the attachment is usable with a wide range of chain saw sizes by mounting the adjustment block to a guard which is slideable within the attachment and is firmly securable thereto. The guard is positioned so that the adjustment screw may contact the particular chain saw housing, and the guard is then firmly secured to the universal bar and housing plate. Thus, the force produced by turning the adjustment screw against the chain saw housing is transmitted through the adjustment block to the sliding guard, and from the sliding guard to the universal bar and housing plate, thereby tightening the chain.

The present invention is also concerned with the power transmission between the chain saw engine and spindle, which may include a V-belt and pulley drive rather than a roller chain drive. The driving pulley is preferably of an annular configuration which slips over the toothed chain saw sprocket and includes a dog adapted to interfit between adjacent sprocket teeth.

Similarly, the driven pulley is a V-belt pulley. To maintain proper axial alignment of the driven pulley, it is fabricated with a stepped bore. The internal shoulder thus created is dimensioned and located against the end of the spindle so that the V-belt is aligned in the same plane as the chain.

Other aims and advantages of the invention will become apparent to those skilled in the art from the detailed disclosure.

BRIEF DESCRIPTION OF THE DRAWINGS

FIG. 6 is an exploded perspective view of the attachment of the present invention showing an alternate drive system;

FIG. 7 is a side view of the alternate drive system of FIG. 6; and

FIG. 8 is a sectional view taken along lines 8—8 of FIG. 7.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
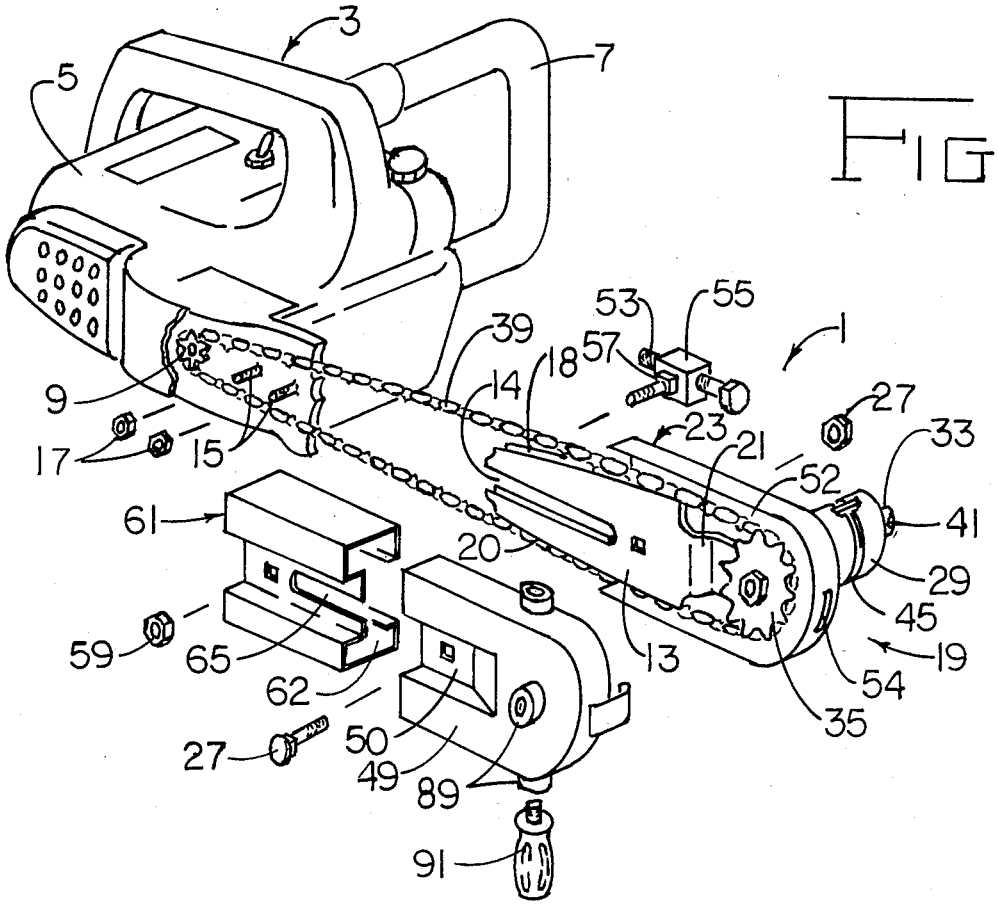
FIG. 1 is an exploded perspective view of the attachment of the present invention.

Referring to FIG. 1, a power tool attachment 1 is illustrated which includes the present invention. The power tool attachment finds particular usefulness for increasing the versatility of a conventional chain saw 3. However, it will be understood that the attachment is not limited to use with a chain saw.

The chain saw 3 typically includes a housing 5 and one or more handles 7. The power output is a rotatable sprocket 9. A cutting chain, not shown, is trained around the sprocket 9 and around a chain bar, not shown, in known fashion. As described, the chain saw is useful only for performing sawing type cutting operations.

The attachment 1 includes a generally flat universal bar 13 which is interchangeable with the chain bars of a wide variety of chain saw models. For that purpose, the universal bar 13 contains a longitudinal slot 14 adapted to fit over mounting studs 15 which, together with nuts 17, constitute the usual means for fastening the chain bar to the chain saw 3. The universal bar is grooved along upper and lower surfaces, 18 and 20, respectively, in a manner similar to conventional chain bars. The distal end 19 of the universal bar is offset at 21 for a purpose to be described presently. The grooves 18 and 20 terminate at the offset portion 21.

Figure 2:
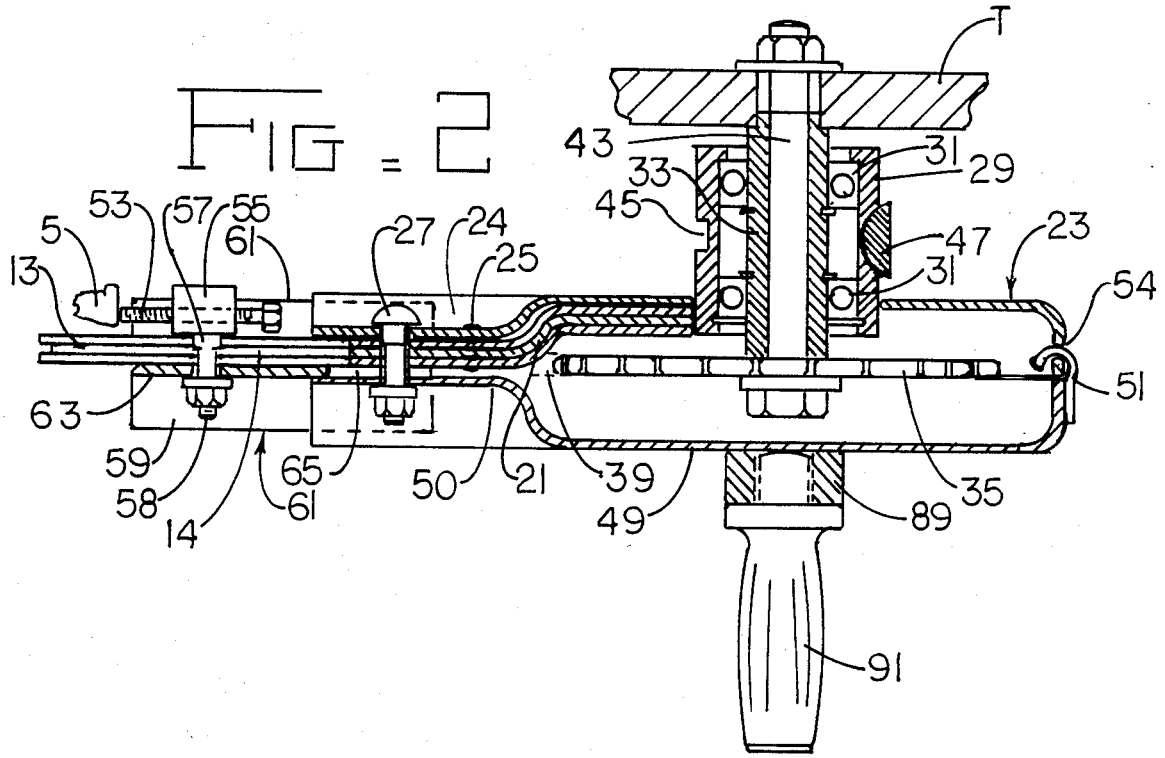
FIG. 2 is a longitudinal sectional view of the tool mounting and driving end of the attachment of the present invention.

Permanently fastened to the universal bar 13 is a housing plate 23. The housing plate 23 has a recessed area 24, FIG. 2, which lies adjacent to the universal bar. Fastening of the housing plate to the universal bar may be accomplished by spot welds at 25 between the recessed area 24 and the universal bar and by fasteners 27 extending through aligned apertures in the universal bar and housing plate recessed area.

Welded to the offset portion 21 of the universal bar 13 and housing plate 23 is a spindle housing 29. The welding of the universal bar and housing plate at spindle housing 29 increases the rigidity of the universal bar. Mounted for rotation within the spindle housing about an axis generally perpendicular to the plane of the universal bar by means of bearings 31 is a hollow spindle 33. The spindle is rotated by a sprocket 35 mounted thereon. Rotational driving force to the spindle may be accomplished through corresponding flats 37 on the spindle and sprocket 35. Power from the chain saw 3 is transmitted to the sprocket via a conventional roller chain 39, which is guided in grooves 18 and 20. To transmit torque from the spindle to a tool T or to the driven shaft of other equipment, the outer end of the spindle is formed with at least one and preferably two flats 41, FIG. 3. The spindle is hollow, so that a long fastener, such as bolt 43, may extend therethrough for attaching various tools to the spindle. The outer diameter of the spindle housing is useful for mounting various types of rotatable equipment, as will be explained. To axially hold various equipment mounted over the spindle housing, the spindle housing outer periphery is manufactured with an annular groove 45. The equipment mounted to the spindle housing periphery is prevented from rotating thereabout by a key 47.

For safety reasons, a cover 49 is joined to and cooperates with the housing plate 23 to enclose the sprocket 35 and to define a generally semi-ovular passageway 52 for enclosing the chain 39. The cover 49 has a recessed area 50 which generally corresponds with the recess 24 of the housing plate and which is proximate the universal bar 13 when the cover is in place. The distal end 19 of the cover may have a tab 51 which fits into an associated slot 54 in the housing plate. The other end of the cover may be secured by the fasteners 27 which join the housing plate to the universal bar 13.

Further in accordance with the present invention, positive means is provided for adjusting the tension in the chain 39 and for maintaining the tension at the desired level. In the illustrated construction, an adjustment screw 53 is threaded through an adjustment block 55. The adjustment block 55 is mountable to the attachment through a square shank 57 having threaded end 58 and a nut 59. The shank 57 passes through a square aperture in a sliding guard 61 and also through the universal bar slot 14. The guard 61 is shaped in cross section with channels 62 which nest within the cooperating passageways 52 formed by the housing plate 23 and cover 49. The guard includes a connecting panel 63 which connects the channels 62 and is slideable between the recessed area 50 of the cover 49 and the universal bar 13. The guard panel 63 defines a longitudinal slot 65 through which the fasteners 27 extend. When the fasteners 27 and 59 are loosened, the guard is slidable along the universal bar and within the housing plate and cover passageways. Consequently, the guard may be positioned within the attachment 1 to bring the adjustment block within the range of the adjustment screw for bearing against the housing 5 of the particular chain saw with which the attachment is to be used. When the fasteners 27 and 59 are tightened, the guard becomes a fixed member of the attachment. Thus, with the guard firmly in place, positive adjustment is available for tensioning the chain 39 of a wide variety of chain saw models. To suit an even larger number of different model chain saws, the adjustment block may be mounted on either side of the attachment.

Figure 3:
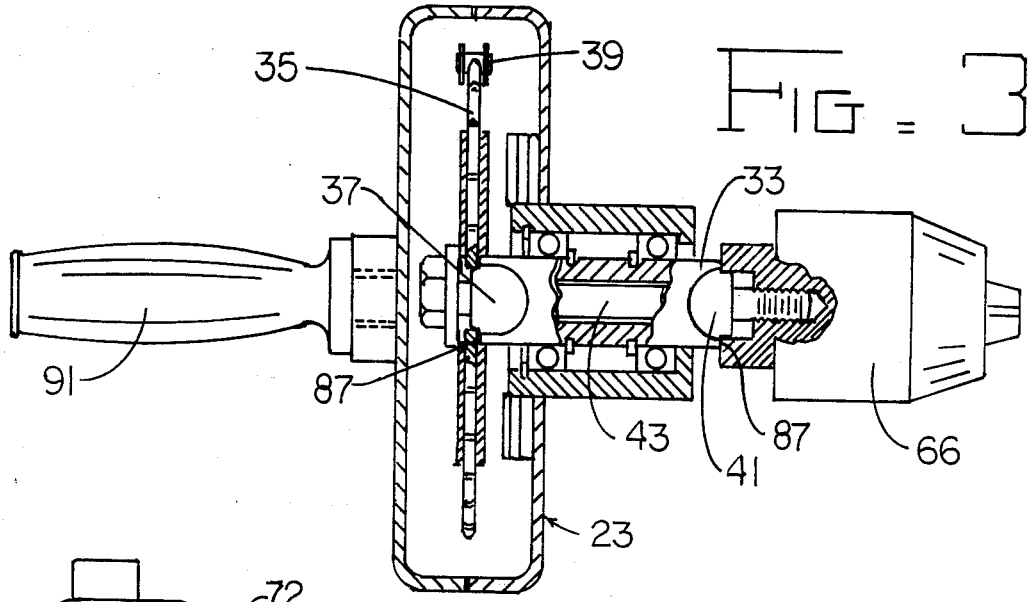
FIG. 3 is a partial transverse sectional view taken through the spindle of the present invention and showing a typical tool held by the spindle.

As an illustration of the versatility of the attachment 1 of the present invention, FIG. 3 shows a conventional drill chuck 66 mounted to the attachment by the bolt 43. The chuck 66 slips over the end of the spindle 33 and is driven by the spindle flats 37.

Figure 4:
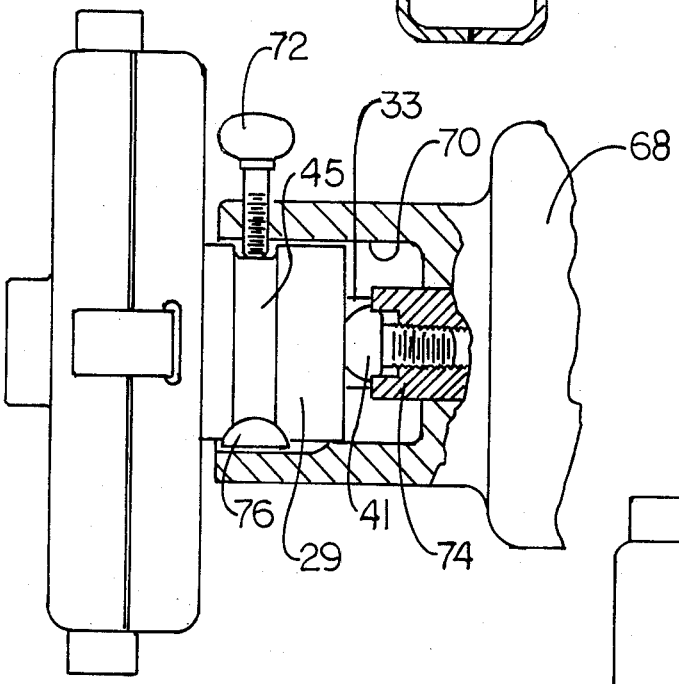
FIG. 4 is a partial sectional view generally similar to FIG. 3 but showing a water pump mounted to the attachment of the present invention.

In FIG. 4, a water pump 68 having an inner pilot 70 is shown mounted over the spindle housing 29. Axial movement of the pump 68 is prevented by a thumb screw 72 or similar device which engages groove 45. Rotation of the pump housing relative to the spindle housing is prevented by key 76. The pump shaft 74 fits over the spindle 33 and is driven by spindle flats 37.

Figure 5:
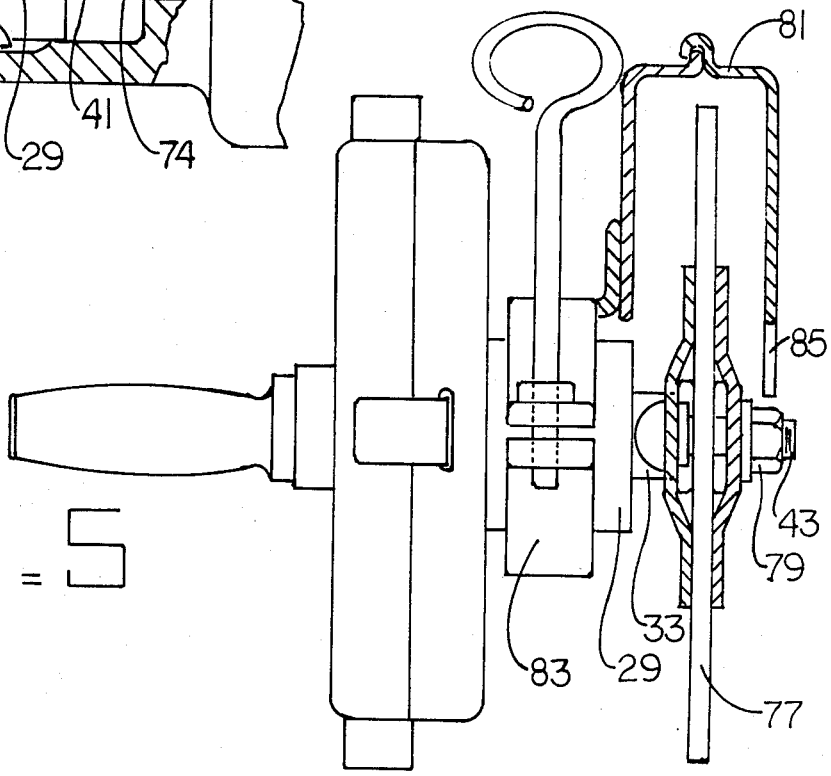
FIG. 5, is a partial sectional view generally similar to FIGS. 3 and 4 but showing a grinding disc mounted to the attachment of the present invention.

Referring to FIG. 5, an abrasive wheel 77 is shown mounted to the spindle 33 by bolt 43 and a nut 79. A guard 81 having a collapsible mounting hub 83 is piloted over spindle housing 29. The guard 81 may have a variety of openings 85 therethrough for providing access of the wheel 77 to the work piece, as is known in the art.

It is a feature of the present invention that the spindle 33 need not be driven by a chain and sprocket system. Referring to FIGS. 6 and 7, a V-belt drive 67 is illustrated. The advantages of a V-belt drive are well known, and they include quiet operation without abrasion and the attendant need for lubrication. In the illustrated construction, the drive 67 includes an annular pulley 69 which is adapted to slip over the conventional drive sprocket 9. Dog 71 is designed to fit between adjacent teeth of the sprocket 9 for imparting torque to the pulley 69. The driven sprocket 35 is replaced by a V-belt pulley 73, which may be of laminated construction, FIG. 8. The width of the V-belt 75 may be greater than that of the chain 39, and the width of the pulley 73 is then correspondingly wider than the sprocket 35. To provide proper axial alignment for the V-belt 75, the pulley 73 is fabricated with a stepped bore, creating an alignment shoulder 87 which locates against the end of the spindle.

To further increase the convenience and usefulness of the attachment 1, the cover 49 is provided with a number of threaded bosses 89. A conventional handle 91 may be screwed into the boss which best suits the operation at hand.

In operation, the usual chain bar is removed by loosening and removing the nuts 17. The cutting chain is also removed. The slot 14 of universal bar 13 is placed over the studs 15. The chain 39 is trained over the chain saw sprocket 9 and the attachment sprocket 35. The nuts 17 are snuggly, but not tightly, replaced. The fasteners 27 and 59 are loosened, and the guard 61 is positioned along the attachment 1 so that the chain saw housing 5 is within the range of adjusting screw 53. The adjustment block 55 is placed on the side of the attachment which best suits the particular chain saw housing. The adjustment screw is rotated so as to bear against the chain saw housing and produce the correct tension on the chain. The nuts 17 are then tightened. The adjustment screw maintains the tension at the desired level during subsequent operations, despite vibrations and cutting forces. If the V-belt drive 67 is employed, the annular pulley 69 is slipped over the sprocket 9, the pulley 73 is used in place of sprocket 35, and V-belt 75 is used in place of chain 39.

Thus, it is apparent that there has been provided, in accordance with the invention, a universal power bar which fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An attachment for mounting one of a variety of tools thereon for being driven by a source of power comprising:

a. generally flat bar means for mounting to the power source and extending longitudinally therefrom toward a distal end;

b. housing plate means joined to the bar means for stiffening the bar means;

c. cover means for removably joining to and cooperating with the housing plate means to define a generally ovular passageway through the housing plate means and cover means;

d. spindle means mounted to the housing plate means for rotating a selected tool;

e. drive means for transmitting power from the power source to the spindle means, the drive means being at least partially enclosed by the ovular passageway in the housing plate means and cover means;

f. a sliding guard having a pair of spaced channels adapted to nest and slide within the passageway formed by the housing plate means and cover means to enclose a portion of the drive means, the sliding guard being selectively loosened from or tightened to the housing plate means and bar means; and g. positive adjustment means comprising an adjustment block attached to the sliding guard and an adjustment screw threaded through the adjustment block and adapted to bear against the power source, so that the sliding guard may be positioned along the attachment to permit the adjustment screw to bear against the power source and tightened to the housing plate means and bar means to permit tensioning of the drive means through the adjustment screw bearing against the power source.

2. The attachment of claim 1 wherein the sliding guard is fabricated with a panel member connecting the guard channels, the panel being slideably interposed between the bar means and the cover means.

3. In combination with a chain saw having an engine, a housing, a power output sprocket, a cutting chain, a chain bar, and studs for mounting the chain bar to the housing, an attachment adapted to hold one of a plurality of selected tools and to rotate the selected tool by means of the chain saw power output sprocket comprising:

a. a universal bar adapted to mount to the chain saw housing interchangeably with the chain bar and having an offset portion at the end thereof distal from the chain saw, the bar defining a longitudinal slot for receiving the chain saw studs therethrough;

b. a housing plate joined to the universal bar at the distal end thereof;

c. cover means for removably joining to and cooperating with the housing plate to define a generally ovular passageway therein;

d. a spindle housing fastened to the housing plate and offset portion of the universal bar;

e. spindle means mounted for rotation within the spindle housing and adapted to rotate the selected tool;

f. drive means replacing the cutting chain for transmitting power from the chain saw output sprocket to the spindle means; and g. adjustment means for positively adjusting and maintaining the tension on the drive means comprising:

i. a guard defining channels adapted to slidingly nest within the passageway formed by the housing plate and cover means, the guard having a panel member connecting the channels and slideingly interposed between the universal bar and recessed portion of the cover means;

ii. an adjustment block releasably secured to the guard and universal bar;

iii. an adjustment screw threaded through the adjustment block and adapted to bear against the chain saw housing; and iv. first fastener means for releasably fastening the sliding guard to the universal bar and housing plate, so that the adjustment block may be positioned along and fastened to the attachment to permit the adjustment screw to bear against the housings of a wide variety of chain saw models.

4. The attachment of claim 3 wherein:

a. the sliding guard defines an aperture therethrough aligned with the longitudinal slot of the universal bar; and b. the adjustment block comprises a shank portion removably received within the guard aperture and extending through the universal bar slot, and second fastener means cooperating with the adjustment block shank to releasably fasten the sliding guard to the universal bar, so that the adjustment block may be mounted and secured to either side of the attachment.

* * * * *